US008033960B1

(12) United States Patent
Dalebout et al.

(10) Patent No.: US 8,033,960 B1
(45) Date of Patent: Oct. 11, 2011

(54) NON-LINEAR RESISTANCE BASED EXERCISE APPARATUS

(75) Inventors: William Dalebout, North Logan, UT (US); Michael Olson, Logan, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 12/879,879

(22) Filed: Sep. 10, 2010

(51) Int. Cl.
*A63B 23/12* (2006.01)

(52) U.S. Cl. ..... 482/38; 482/123; 482/130

(58) Field of Classification Search ..... 482/38–42, 482/130, 129, 121–123, 26, 95–96, 148
See application file for complete search history.

(56) References Cited

U.S. PATENT DOCUMENTS 3,118,441 A 1/1964 George
3,652,085 A 3/1972 Cole
4,059,265 A 11/1977 Wieder et al.
4,073,490 A 2/1978 Feather
4,257,590 A * 3/1981 Sullivan et al. ..... 482/94
4,328,964 A 5/1982 Walls
D264,862 S 6/1982 Kokoska
4,428,578 A 1/1984 Kilpatrick
4,463,948 A 8/1984 Mohr
4,606,541 A 8/1986 Kilpatrick
4,611,805 A 9/1986 Franklin et al.
4,685,670 A 8/1987 Zinkin
4,685,671 A 8/1987 Hagerman et al.
4,830,365 A 5/1989 March
4,844,448 A 7/1989 Niznik
4,861,020 A 8/1989 Soligny, Sr.
4,909,505 A 3/1990 Tee
5,040,788 A 8/1991 Randall
5,100,129 A 3/1992 Porter et al.
5,135,445 A 8/1992 Christensen et al.
5,209,482 A 5/1993 Hopfer
5,221,240 A 6/1993 Mann et al.
5,254,065 A 10/1993 Pollock
5,277,683 A 1/1994 Wilkins
5,352,174 A 10/1994 Mason et al.
5,407,404 A * 4/1995 Killian et al. ..... 482/38
5,415,608 A 5/1995 Bode et al.
5,468,205 A * 11/1995 McFall et al. ..... 482/129
5,498,223 A 3/1996 Iams et al.
5,505,677 A 4/1996 Hinds
5,522,783 A 6/1996 Gordon
5,571,064 A 11/1996 Holm
5,597,376 A 1/1997 Bode et al.
5,601,518 A 2/1997 Weintraub
5,624,360 A 4/1997 Wilkins
5,766,118 A 6/1998 Conner
5,807,214 A 9/1998 Riazi
5,813,956 A 9/1998 Iams et al.
5,820,529 A 10/1998 Weintraub
5,871,424 A 2/1999 Conner
5,910,073 A 6/1999 Conner
5,924,966 A 7/1999 Havlovic
5,957,819 A 9/1999 Cortesi
6,015,371 A 1/2000 Davitt
6,036,625 A 3/2000 Woodruff
(Continued)

*Primary Examiner* — Stephen Crow
(74) *Attorney, Agent, or Firm* — Holland & Hart

(57) ABSTRACT

An exercise apparatus includes a base. A first and second vertical support members are coupled to the base. Additionally, a resistance assembly is coupled to the first and second vertical support members. When viewed from the base, the first and second support members converge relative to one another until mutual vertices. The first and second support members then diverge relative to one another above the vertices.

20 Claims, 11 Drawing Sheets

U.S. PATENT DOCUMENTS 6,059,698 A 5/2000 Mazor
6,110,075 A 8/2000 Wodruff
6,183,403 B1 2/2001 Dunn
6,267,711 B1 7/2001 Hinds
6,319,179 B1 11/2001 Hinds
6,322,483 B1 11/2001 Rotella
6,494,817 B2 12/2002 Lake
6,515,182 B2 * 2/2003 Hosokawa et al. ..... 564/427
6,540,651 B1 4/2003 Aberton
6,908,418 B2 * 6/2005 Saure ..... 482/121
6,941,620 B1 9/2005 Hinds
6,994,683 B1 2/2006 Starr
7,044,897 B2 * 5/2006 Myers et al. ..... 482/99
7,048,638 B2 5/2006 Novotny
7,255,666 B2 * 8/2007 Cardenas ..... 482/143
7,322,909 B1 1/2008 Loccarini et al.
2003/0158024 A1 8/2003 Saure
2003/0186792 A1 10/2003 Keeler
2004/0087420 A1 5/2004 Montesquieux
2006/0189460 A1 8/2006 Katterjohn
2007/0018465 A1 1/2007 Vassilakos et al.

* cited by examiner

NON-LINEAR RESISTANCE BASED EXERCISE APPARATUS

BACKGROUND

Exercise apparatuses commonly employ a weight stack actuated by a cable which is pulled by users of the apparatus. Recently, resistive elastic members, such as bands or plates, have been incorporated into exercise equipment to provide motion resistance. Specifically, resistive elastic members have gained increased popularity due to their ability to provide substantially consistent tension throughout the desired range of motion and generate an increased use of stabilizer muscles to oppose the substantially consistent tension while providing resistance in a large number of directions and ranges of motion.

While the use of resistive elastic members provides many benefits, a number of the traditional apparatus configurations can present limitations affecting the usefulness of the exercise apparatus. For example, the range of exercises which may be performed with certain cable actuated apparatuses is sometimes limited by the position and orientation of the apparatus itself. Particularly, with the added range of motion and resistance offered by the use of resistive elastic members, such as bands and plates, consumer needs and considerations are often at odds. Particularly, the safety considerations of providing a stable apparatus are constantly at odds with the desire for a system that is relatively compact while providing the ability to perform full body exercises and allow the user to take advantage of a full range of motion.

One type of resistance band apparatus is disclosed in U.S. Pat. No. 6,626,801 issued to Jean Pierre Marques. In this patent, an exercise system includes a pair of elongate side members, a plurality of bar members extending between the side members, a plurality of eyelets attached to a front edge of the side members, and a mat member pivotally attached to a lower portion of the side members. A plurality of attachments can be attached to the bar members and the eyelets to allow the performance of various exercises. An alternative resistance based apparatus is also disclosed in U.S. Pat. App. No. 20080020912 assigned to ICON IP, INC. In this patent, an exercise machine has resilient elongate members for providing balanced resistance in the form of elongate resilient members oriented horizontally such that the intermediate portion of the elongate members contact a fulcrum of the exercise machine.

SUMMARY

In one aspect of the disclosure, an exercise apparatus includes a base, a first vertical support member coupled to the base, a second vertical support member coupled to the base, and at least one resistance assembly coupled to the first vertical support member and the second vertical support member. According to this aspect of the disclosure, the first and second vertical support members converge relative to one another to form a first vertex and a second vertex. Furthermore, the first support member and the second support member diverge relative to one another above the first and second vertex.

Another aspect of the disclosure may include any combination of the above-mentioned features and may further include a first resistance assembly disposed on the first vertical support member and a second resistance assembly disposed on the second vertical support member.

Yet another aspect of the disclosure may include any combination of the above-mentioned features and may further include at least one resistance assembly having at least one elastic resistance member, the at least one elastic resistance member having a first end and a second end. A first coupling feature may be connected to the first end of the at least one elastic resistance member and a second coupling feature may be connected to the second end of the at least one elastic resistance member. Furthermore, a guide system may be included corresponding to the at least one elastic resistance member, the guide system may couple the resistance assembly to one of the vertical support structures using at least three guides, a first guide coupled to a top portion of the vertical support member above the vertex, a bottom guide coupled to a bottom portion of the vertical support member below the vertex, and an intermediate guide corresponding coupled to the vertex of the vertical support member.

Yet another aspect of the disclosure may include any combination of the above-mentioned features and may further include an opening defined in the top guide and the bottom guide, the opening being configured to facilitate passage of the at least one elastic resistance member. According to this embodiment, the first coupling feature and the second coupling feature connected to the ends of the elastic resistance member each have a maximum width that is greater than the opening defined by the top guide and the bottom guide such that they act as anchors when the opposing feature is actuated.

Yet another aspect of the disclosure may include any combination of the above-mentioned features and may further include a vertically oriented base extension member having a first end and a second end, wherein the first end of the vertically oriented base extension member is coupled to a back portion of the base, and a back pad coupled to the second end of the vertically oriented base extension member. According to this embodiment, the back pad is disposed at the vertex of the first vertical support member and at the vertex of the second vertical support member.

Yet another aspect of the disclosure may include any combination of the above-mentioned features and may further include a support bar coupled to the second end of the vertically oriented base extension member, wherein the support bar is configured to project parallel to the base around the vertex of the first vertical support member and the vertex of the second vertical support member in a first position.

Yet another aspect of the disclosure may include any combination of the above-mentioned features and may further include a pivot assembly coupling the support bar to the second end of the vertically oriented base extension member, wherein the pivot assembly is configured to selectively position the support bar in the first position and a second position. According to this embodiment, the second position includes the support bar oriented substantially perpendicular to the base.

Yet another aspect of the disclosure may include any combination of the above-mentioned features and may further include a substantially horizontal protrusion disposed on top of each of the first and second support member.

Yet another aspect of the disclosure may include any combination of the above-mentioned features and may further include a horizontally oriented pull-up bar traversing the substantially horizontal protrusion disposed on top of each of the first and second support member substantially above a median plane of the base.

Yet another aspect of the disclosure may include any combination of the above-mentioned features and may further include the base having a front surface, a back surface, a first side surface, and a second side surface. According to this embodiment, the first vertical support member is coupled to the base near a midpoint of the first side surface, the second vertical support member is coupled to the base near a midpoint of the second side surface, the first and second vertical support member below the first and second vertex is oriented toward the back surface of the base, and the first and second vertical support member above the first and second vertex is oriented toward the front surface of the base.

Yet another aspect of the disclosure may include any combination of the above-mentioned features and may further include the first vertex and the second vertex being coincident.

Yet another aspect of the disclosure may include any combination of the above-mentioned features and may further include the first vertical support member and the second vertical support member coupled near the vertex.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

A stable apparatus configured to take up a relatively small amount of floor space while providing for numerous resistance based exercises and substantially unobstructed movement is provided herein. Specifically, the present exemplary system provides a compact exercise system that enables the performance of multiple exercises. Additionally, as will be described below with reference to the Figures, the present exemplary system may also assume a number of different stable configurations to facilitate the performance of various exercises while maximizing the freedom of motion for the user. All of these previously contradictory interests are simultaneously satisfied by the present exemplary system. A number of exemplary structures and methods of the present resistance based exercise system are described in detail below.

Exemplary Structure

Figure 1:
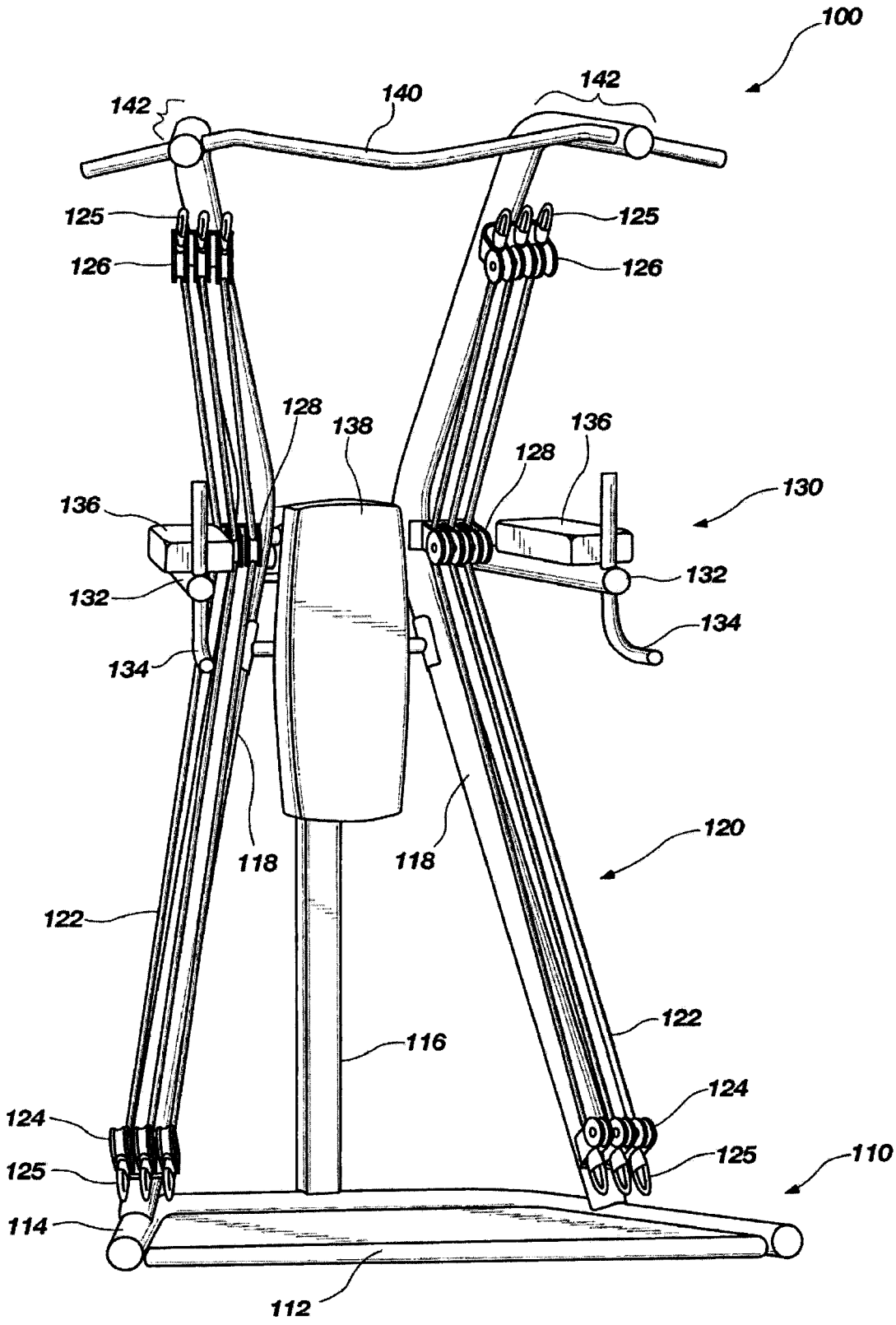
FIG. 1 is a front perspective view of a resistance based exercise apparatus, according to one exemplary embodiment.
Figure 2:
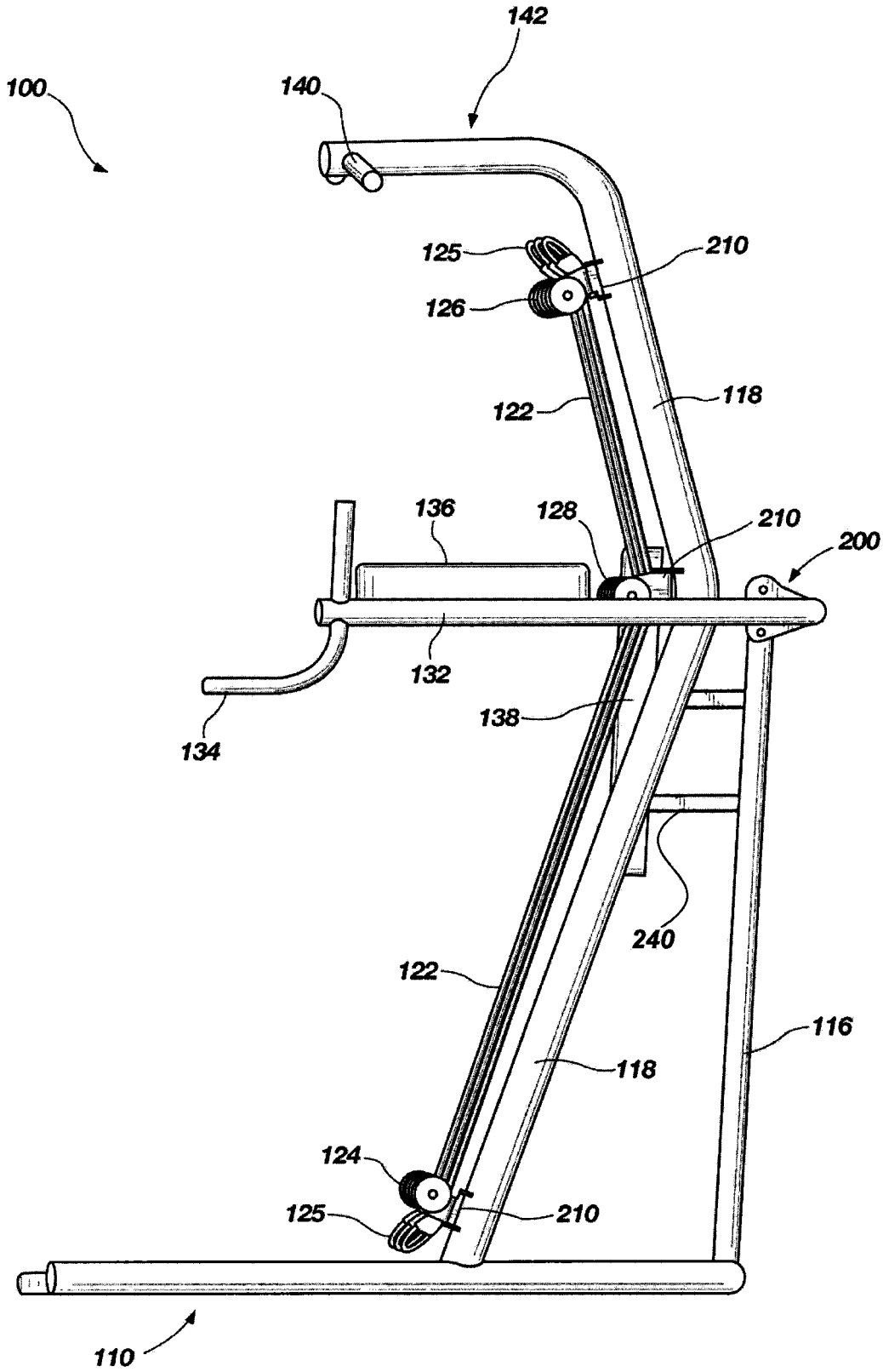
FIG. 2 is a side view of a resistance based exercise apparatus, according to one exemplary embodiment.
Figure 3:
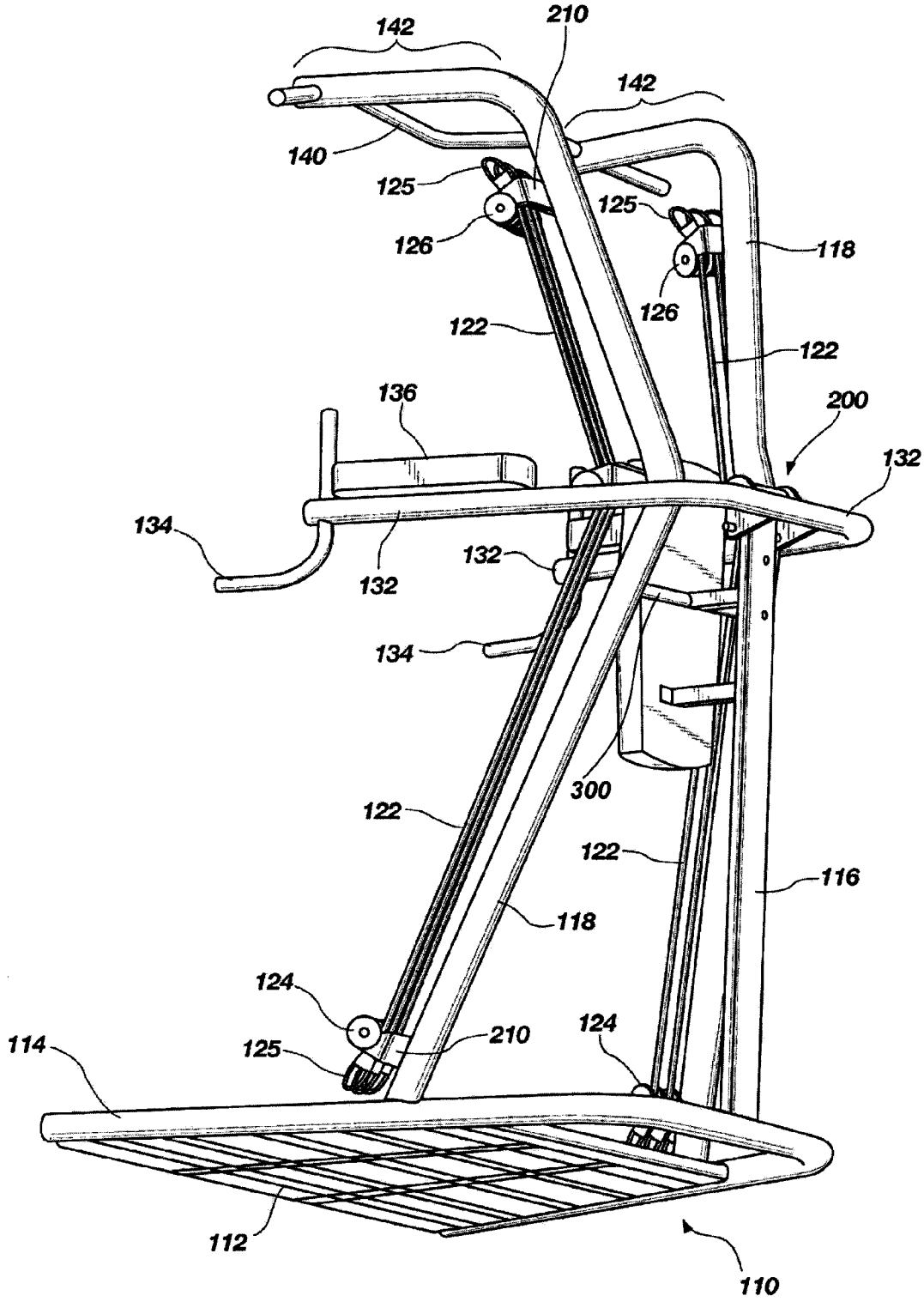
FIG. 3 is a back perspective view of a resistance based exercise apparatus, according to one exemplary embodiment.

With reference to FIGS. 1-3, a resistance based exercise system 100 is disclosed. As noted above, the present exemplary resistance based exercise system 100 is configured to occupy a small yet stable footprint while providing accessibility to numerous resistance based exercises. According to the exemplary embodiment illustrated in FIGS. 1-3, the resistance based exercise system 100 includes a base 110, a vertical support structure 118 and a vertical base extension 116 structurally coupled to the base, a resistance assembly 120 coupled to the vertical support structure, and a collapsible support bar 130 rotatably coupled to the vertical base extension 116. Additionally, as shown in FIGS. 1-3, a pull-up bar 140 may be coupled to the vertical support structure 118. According to one exemplary embodiment illustrated in FIGS. 1-3, the vertical support structure 118 includes a converging and diverging shape that enables the melding of stability, strength, and freedom of motion while maintaining a small yet stable footprint. Further details of the exemplary resistance based exercise system 100 will be provided below with reference to the Figures.

As noted, the present exemplary resistance based exercise system 100 includes a base 110. The base 110 serves as the support structure for the remaining system 100 and engages the floor or other surface upon which the system is positioned and upon which the desired exercises will take place. Consequently, as illustrated, the base 110 includes a platform 112 that provides a substantially flat surface for performing a plurality of exercises while enlarging the stabilizing footprint of the base. According to this exemplary embodiment, during use, the weight of the user is applied to the platform 112 and distributed across the platform and base support 114 to enhance the effective footprint of the base 110, thereby stabilizing the system 100 during operation. The platform 112 may include any number of non-slip surfaces or friction enhancing materials to aid in the stabilization of the user and prevent unintentional motion while exercising. Furthermore, the platform 112 may be made of any number of durable materials including, but in no way limited to, a plastic, a metal, a composite, and the like. According to one exemplary embodiment, the base 110 is formed of a structural plastic in a substantially triangular shape to facilitate placement of the system 100 in a corner of a room while establishing at least three points of contact with the floor or other surface. Alternatively, the base 110 may assume any number of desired configurations aimed at balancing weight, stability, storability, and/or room placement.

Additionally, as illustrated in FIGS. 1-3, the exemplary base 110 includes a perimeter member forming a structural base support 114. According to one exemplary embodiment, the structural base support 114 is a metal tubing member or other structural member that defines the perimeter of the base 110 and serves as a structural frame for housing or retaining the platform 112 and establishes the at least three stabilizing points of contact with the floor or other surface upon which the system 100 is placed. As illustrated in FIG. 1, a number of vertically oriented members are coupled to the base support 114. Particularly, according to the exemplary embodiment illustrated in FIGS. 1-3, the structural base support is coupled and consequently supports the vertically oriented base extension 116 and vertical support structure 118. As shown, forces applied to the base extension 116 and vertical support structure 118 during operation are translated down to the base support 114 where they are dispersed to the entire base 110. According to this exemplary embodiment, the base 110 is configured to distribute the applied forces and greatly reduce the likelihood of destabilizing the system 100. Further details and features that may contribute to the stability of the exemplary structure are detailed below.

Continuing with the base structure 110, a base extension 116 is fixedly coupled to the base support 114 and protrudes in a vertical direction. According to the illustrated embodiment, the base structure 110 may be coupled to the base support via any number of joining techniques including, but in no way limited to a weld, fasteners, and the like. According to the illustrated embodiment, the base extension 116 protrudes vertically to provide a mounting location for a back pad 138 that defines a user location during operation. As shown in the exemplary figures, one or more mounting members 240 may be coupled to both the base extension 116 and the back pad 138 to define the positional height of the back pad 138. The coupling of the back pad 138 to the one or more mounting members 240 may be fixed or, alternatively, may be adjustable to vary the back pad position according to the user's height and preferences. Additionally, as illustrated, the vertically oriented base extension 116 defines the back plane of the base 110 and functions as a mounting point for a collapsible support bar pivot assembly 200, as will be discussed in further detail below, with reference to FIGS. 2-7.

Continuing with the exemplary embodiment illustrated in FIGS. 1-3, the base support 114 is also coupled to a first and a second vertical support structure 118. While the present exemplary system is illustrated as having a first and a second vertical support structure 118, a number of additional support structures 118 may be implemented for structural and/or functional enhancements. As shown in the exemplary embodiment of FIG. 1, the lower ends of the first and second vertical support structures 118 are spaced apart a distance substantially equal to the width of the base support 114. As the first and second vertical support structures progress in a vertical direction, they converge toward each other to form a number of coincidental vertices near the back pad 138. Continuing in a vertical direction, the first and second vertical support structures 118 then diverge from one another such that at their upper most point they are again spaced apart from one another a substantial amount. As illustrated in FIG. 1, the first and second vertical support structures 118 assume an "X" shaped profile. According to one exemplary embodiment, the distance between the first and second vertical support structures 118 at the base support 114 and at the upper most vertical point is substantially the same. However, according to alternative embodiments, the relative distances between the first and second vertical support structures 118 may vary. Furthermore, while the first and second vertical support structures are illustrated as linear members converging to form a vertex and then diverging linearly, the converging and diverging portions of the first and second vertical support structures may be curved or arcuate members.

According to one exemplary embodiment, the convergence and subsequent divergence of the first and second vertical support structures 118 relative to one another provides a number of advantages to the present exemplary system 100. Specifically, the convergence and subsequent divergence of the first and second vertical support structures 118 relative to one another provides for the maximum range of motion to be available for a user when performing exercises in the arm/shoulder actuation zone. That is, if the first and second vertical support structures 118 did not assume a converging and diverging orientation, but rather had a linear configuration (e.g., substantially maintaining their distance from one another as they extend vertically from the base support 114 to their upper most extents), the areas directly proximal or distal to a user's elbows, depending on their orientation, would be occupied by the vertical support structures 118 and would thereby limit the user's ability to have a full range of movement of his/her arms. However, as illustrated in FIG. 1, the convergence and subsequent divergence of the vertical support structures 118 relative to one another allows for a substantially full range of motion for the user's arms and greatly reduces the likelihood that a user will become injured due to contact with the support structure.

Additionally, the convergence and divergence of the vertical support structures 118 enhance the stability of the structure 100. Particularly, according to one exemplary embodiment, when viewed from the extreme points of the vertical support structures 118, when a user actuates the resistance assembly 120, a force, equal and opposite to the force exerted by the user, is applied to the system. Due to the "X" shape assumed by the vertical support structures 118, the opposing or reactive force inserted into the system at the extreme points of the vertical support structures 118 is directed toward the center of the vertical support structures, rather than toward the edge of the base 110, thereby maintaining the stability of the system 100.

Additionally, as illustrated in FIG. 2, the first and second vertical support structures 118 engage the base 110 away from the back of the horizontal base support 114 toward the midpoint between the front and back extremes. This configuration also provides stability to the system 100 such that as the vertical support structures 118 rise from the base 110, they angle back toward the base extension 116 to an vertex near the back pad 138. Continuing in a vertical direction, the first and second vertical support structures 118 then proceed toward the front of the system 100. At the top of the exemplary first and second vertical support structures 118 illustrated in FIG. 2, the support structures change direction nearly 90 degrees such that they are substantially parallel with the base 110 and form a pull-up bar protrusion. According to the exemplary embodiment illustrated in FIG. 2, the exemplary configuration facilitates freedom of motion for the user by positioning the vertical support structures 118 away from the user's arms while also placing the center of weight distribution on the relative center of the base support to provide for stability during the performance of the various exercises. Notably, as illustrated in FIG. 2, when a user performs an exercise, such as pull-ups, using the pull-up bar 140 located at the end of the pull-up protrusion 142, the most extreme vertical moment arm is created in the system. However, as the pull-up protrusion 142 orients the pull-up bar 140 in the median plane of the base 110, forces created at that point are directed to the center of the base 110 and do not create a substantial tipping force.

FIG. 3 illustrates the rear of the present exemplary system 100 illustrating that the first and second vertical support structures 118 do not cross and are not directly coupled. Rather, the first and second vertical support structures are coupled via the base support 114, the pull-up bar 140, and the center horizontal support member 300 illustrated in FIG. 3. According to the present exemplary embodiment, any number of horizontal support members may be connected between the first and second vertical support structures 118 to provide the desired amount of tangentially supporting structure. Alternatively, the first and second vertical support structures 118 could be mechanically joined, via weld, fasteners, and the like, to cross or at least abut each other, thereby forming a true "X" configuration. Numerous additional supports and orientations may be assumed by the vertical support structures while maintaining the above-mentioned advantages.

According to the present exemplary embodiment, the vertical support structures 118 are fabricated of hollow tubing to balance both strength and weight considerations. While the present exemplary system is illustrated with the vertical support structures 118 being formed of steel tubing having a substantially circular cross-section, the vertical support structures 118 may assume any number of cross-sectional configurations configured to provide the desired structural strength including, but in no way limited to, oval, box, rectangular, I-beam, and the like. Additionally, according to one exemplary embodiment, the vertical support structures 118 are formed of a metal such as, but in no way limited to, steel, aluminum, and the like. Alternatively, any sufficiently stable material, or combination of materials may be used to form the present exemplary vertical support structure including, but in no way limited to, composites, polymers, etc.

Continuing with FIGS. 1-3, a resistance assembly 120 is coupled to the exemplary system 100. As illustrated, the exemplary resistance assembly 120 includes a plurality of elastic members 122 of similar or varying resistance. According to one exemplary embodiment, the elastic members 122 forming a portion of the resistance assembly 120 may be identified as having a resistance that is quantified as providing resistance equivalent to a commensurate weight in a weight stack. In one exemplary embodiment, each resistance assembly 120 coupled to a vertical support structure 118 may include elastic members 122 varying in 5 pound resistance increments, up to, for example, 60 pounds.

As shown, each of the plurality of elastic members 122 includes a coupling feature 125 on each end of the elastic member that is configured to be coupled, either independently or with additional coupling features 125, via a carabineer or other coupling device (510, FIG. 5), to an engagement member (500, FIG. 5) such as a grip or band that may be engaged by or fastened to a user for the performance of a desired exercise. According to the exemplary embodiment illustrated in FIGS. 1-3, the coupling features 125 formed on each end of the elastic members 122 defines an orifice or other engagement feature configured to securely couple a carabineer or other coupling device (510, FIG. 5) configured to facilitate selective attachment of a desired engagement member (500, FIG. 5). Furthermore, according to one exemplary embodiment, the coupling feature 125 includes a base portion having a thickness that is greater than the diameter of the elastic member 122. According to this exemplary embodiment, as each end of the elastic member 122 is free to be independently coupled to and provide resistance to a user via translation of the coupling feature 125, the base portion of the non-translating coupling feature 125 acts as an anchor for the stationary end of the elastic member 122. Particularly, according to one exemplary embodiment, the elastic members 122 are each configured to translate along a guide such as a grooved roller when actuated. According to the present exemplary embodiment, the base portion of the coupling feature 122 is sufficiently large to prevent passage through the guide, such as a grooved roller assembly. Further detail of the guide assembly is provided below.

While the present exemplary system 100 is illustrated and described, for ease of explanation, as incorporating a resistance assembly utilizing elastic members such as bands, plates, and the like, any number of resistance systems may be incorporated by the present system including, but in no way limited to a cable system including an actuated weight stack.

As noted above, the resistance assembly 120 including the elastic members 122 may, according to one exemplary embodiment, be coupled to the vertical support structures 118 via a plurality of guides. According to one exemplary embodiment, the guides include a number of grooved rollers. As shown in FIGS. 1-3, the resistance assembly 120 is coupled to the vertical support structures by a plurality of top rollers 126, bottom rollers 124, and intermediate rollers 128 that are, in turn, coupled to the vertical support structures 118 by a roller bracket 210. As illustrated, the top rollers 126 and bottom rollers 124 are coupled to the top and bottom portions of the vertical support structures 118, respectively. According to this exemplary embodiment, the top rollers 126 and the bottom rollers establish the connection point for conducting resistance based exercises. According to one exemplary embodiment, the top rollers 126 and the bottom rollers 124 may be coupled to the vertical support structures 118 via a rail to enable selective positioning of the rollers.

According to the present exemplary embodiment, the top 126, bottom 124, and intermediate rollers 128 are pivotably coupled to the vertical support structure to add an increased freedom of motion. Specifically, according to one exemplary embodiment, the top rollers 126 and bottom rollers 124 are configured to independently pivot, relative to the other rollers, according to the directional actuation of the elastic member (s) 122. According to one exemplary embodiment, the lateral pivoting of the top rollers 126 and bottom rollers 124 ensures that the actuation of the elastic member(s) 122 from various angles can be performed smoothly and without abrupt movements or binding that may otherwise inhibit a full range of motion by the user and could cause joint stress and injury.

As illustrated in FIGS. 1-3, a number of intermediate rollers 128 are disposed at or near the vertex of the converging vertical support structures 118. According to the present exemplary embodiment, the intermediate rollers 128 are configured to vary the direction of the elastic members 122 from a single linear path between the bottom rollers 124 and the top rollers 126. Specifically, without the intermediate rollers 128, the elastic members 122 would be positioned linearly between the top rollers 126 and the bottom rollers 124. This would substantially eliminate a number of the advantages provided by the converging and diverging vertical support structure 118. Consequently, the intermediate rollers 128 are configured to cause the elastic members 122 to substantially follow the path of the vertical support structure 118.

While the present exemplary embodiment is described in the context of using a plurality of rollers as guides to channel and direct the elastic members 122 through a change in direction, any number of guides may be used to channel the elastic members 122 including, but in no way limited to, low friction cylinders, bearings, and the like.

As noted previously, and as illustrated in FIGS. 1-3, the exemplary system 100 also includes a collapsible support bar 130 rotatably coupled to the base extension 115 by a collapsible support bar pivot assembly 200. According to one exemplary embodiment, the collapsible support bar can be securely positioned in a horizontal position, parallel with the base 110 to enable a plurality of exercises including, but in no way limited to, leg lifts, dips, crunches, and the like. As shown, the collapsible support bar 130 can be made of a metal tube material having a round or elliptical cross-section. Alternatively, any number of structural materials assuming any number of cross-sectional configurations may be used. As illustrated, the collapsible support bar 130 includes two substantially ninety degree bends, forming a "C" shaped member 132 having a back portion and two protruding arms. According to the exemplary embodiment illustrated in FIGS. 1-3, the center of the "C" shaped member 132 is coupled to the collapsible support bar pivot assembly 200 and the two protruding arms are oriented horizontal to the base, when in a first position. As illustrated, an arm pad member 136 or other padded features may be formed on the "C" shaped member 132 to provide comfort during use of the collapsible support bar 130. A dip bar extension 134 is also illustrated as being formed on each of the terminal ends of the "C" shaped member 132 of the collapsible support bar 130. The exemplary dip bar extensions illustrated in FIGS. 1-3 include a horizontal portion extending beyond the end of the "C" shaped member 132, a ninety degree bend, and a vertical component that passes through and extends vertically above the end of the "C" shaped member. According to the illustrated embodiment, the vertical component of the dip bar extension 134 may be gripped by a user with her forearm engaged with the arm pad 136, her back engaged with the back pad 138 and her legs freely hanging below her. She may then raise her legs in various manners to perform abdominal exercises. Additionally, a user may use the horizontally protruding portions of the dip bar extension 134 to perform dip exercises, either with or without resistance being provided by the elastic members 122.

Figure 4A:
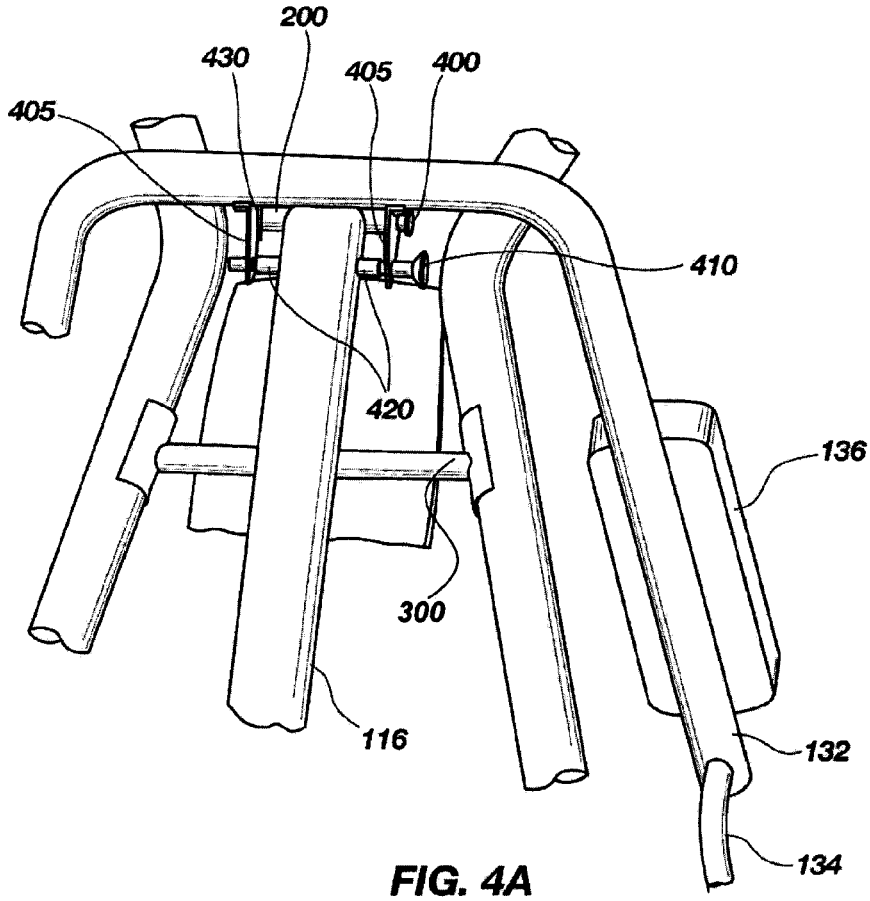
FIG. 4*a* is a bottom view of a selectively rotational coupler on the resistance based exercise apparatus, according to one exemplary embodiment.
Figure 4B:
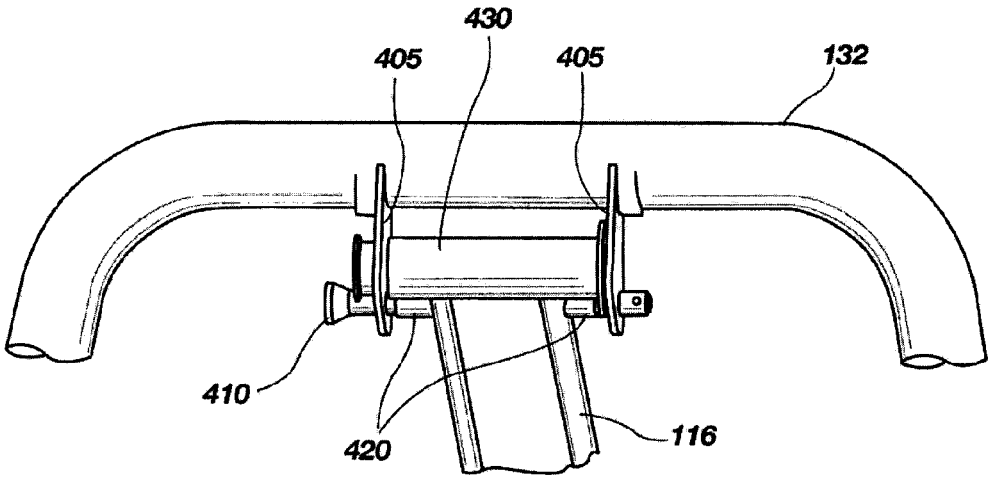
FIG. 4*b* is a top view of a selectively rotational coupler on the resistance based exercise apparatus, according to one exemplary embodiment.
Figure 5:
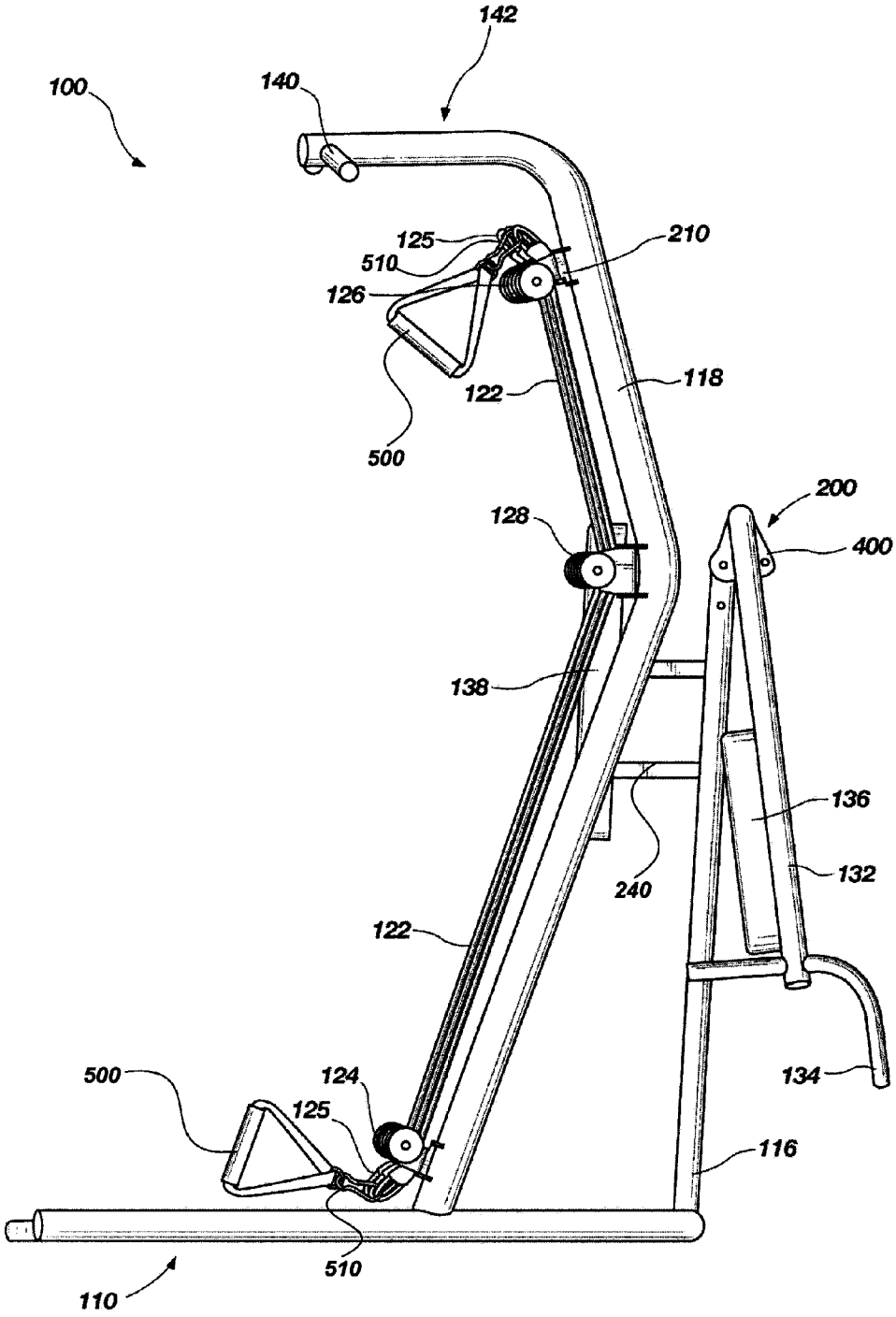
FIG. 5 is a side view of a resistance based exercise apparatus in a second configuration, according to one exemplary embodiment.

As noted previously, the collapsible support bar 130 is rotatably coupled to the top portion of the base extension 116, according to one exemplary embodiment, by a collapsible support bar pivot assembly 200. FIGS. 4*a* and 4*b* further illustrate the features of the collapsible support bar pivot assembly 200, according to one exemplary embodiment. As shown in the bottom view of FIG. 4*a*, the collapsible support bar pivot assembly 200 includes a rotatable bracket 400 that includes a plurality of tabs 405 fixedly coupled to the "C" shaped member 132. Each of the plurality of tabs 405 defines a pin orifice and is simultaneously coupled to a hinged member 430. The hinged member is fixedly coupled to the base extension 116. Additionally, a pin receiving collar 420 is formed in the base extension 116.

Figure 6:
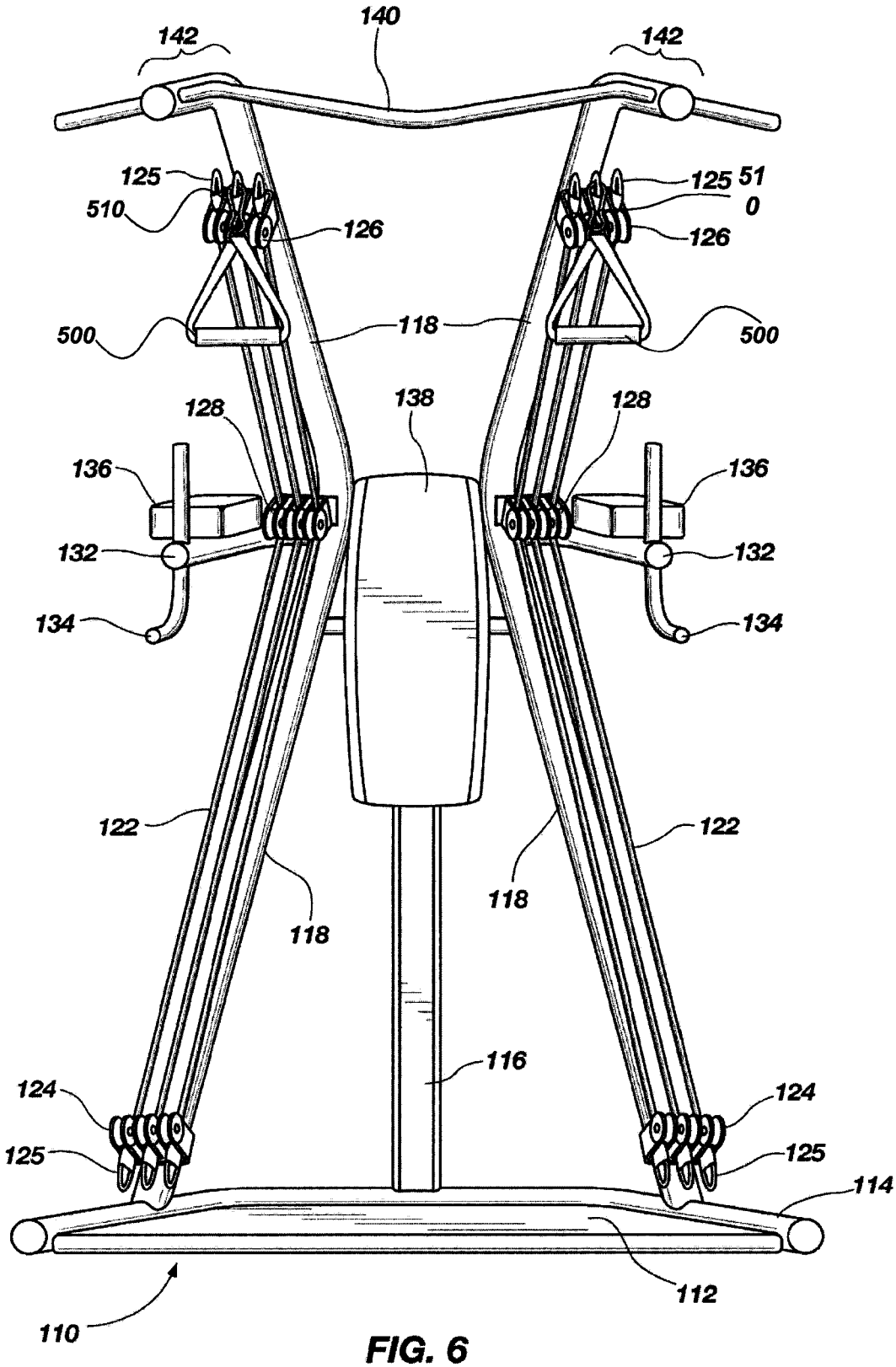
FIG. 6 is a frontal view of a resistance based exercise apparatus, according to one exemplary embodiment.
Figure 7:
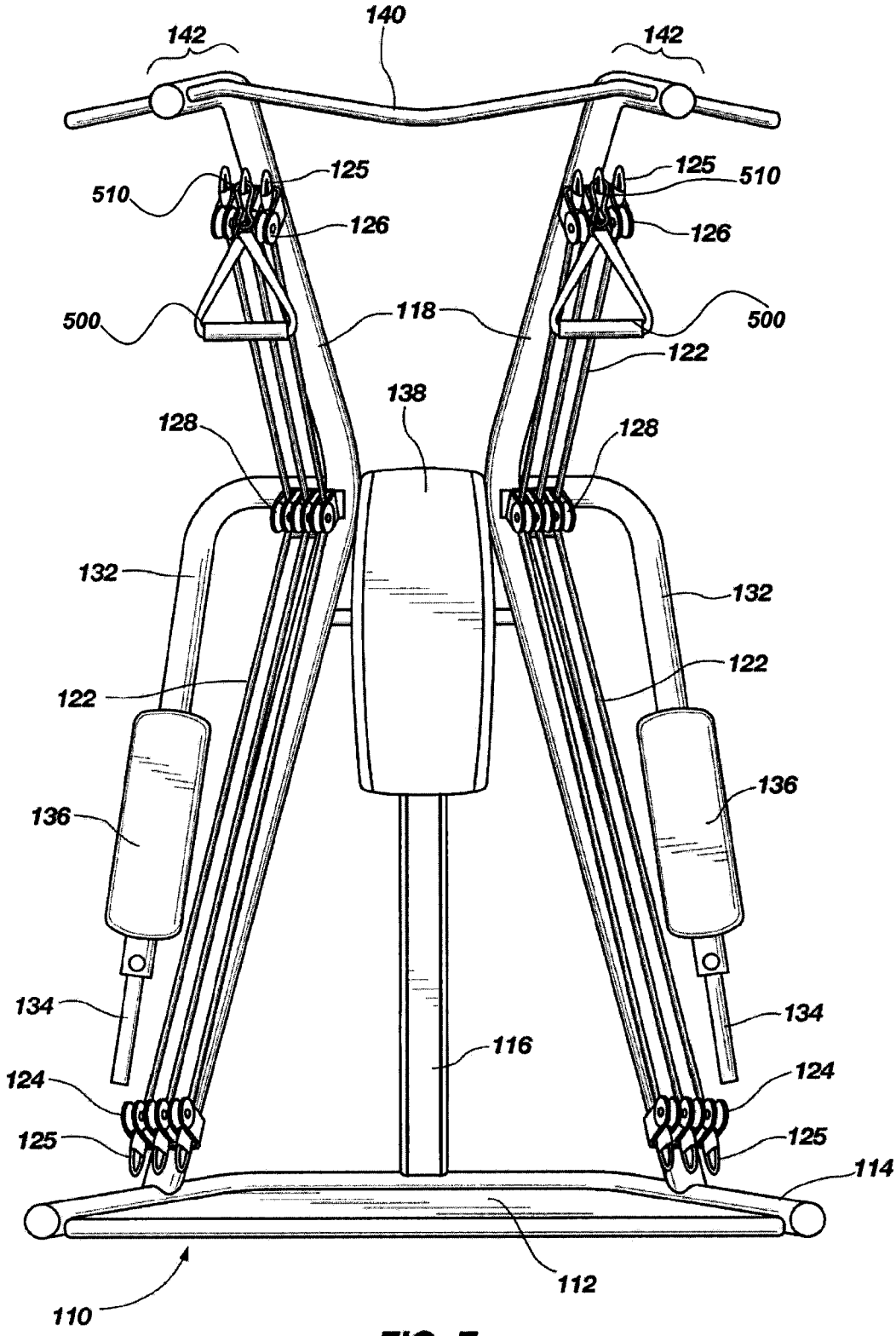
FIG. 7 is a frontal view of a resistance based exercise apparatus in a second configuration, according to one exemplary embodiment.

As illustrated in FIGS. 4*a* and 4*b*, when the collapsible support bar 130 is in a first horizontal position, a pin 410 passes through the orifices defined in the plurality of tabs 405 and passed through the pin receiving collar 420. In this configuration the hinged member 430 and the pin 410 securely fix the rotational position of the collapsible support bar 130 and the above-mentioned exercises may be performed. However, as illustrated in FIG. 6, when the collapsible support bar pivot assembly 200 is in the first position and the "C" shaped member 132 is in its horizontal position it could potentially interfere with the arm motion of a system user.

When a user then desires to perform a desired exercise where arm clearance is desired, the collapsible support bar 130 may be rotated to a second stable position. According to one exemplary embodiment, the collapsible support bar 130 is rotated to a second position by removing the pin 410 from the pin receiving collar 420 and the orifices defined in the plurality of tabs 405. According to this exemplary embodiment, the previously established two points of contact are reduced to one and the collapsible support bar 130 is free to rotate about the hinged member 430. According to one exemplary embodiment illustrated in FIGS. 5 and 7, the weight of the collapsible support bar 130 will cause it to rotate about a pivot point in the center of the hinged member 430. Since the hinged member 430 is coupled to the base extension 116, the collapsible support bar 130 will drop and come to rest in its second position perpendicular to the base 110. As illustrated, in one exemplary embodiment, the internal distance between the two protruding portions of the "C" shaped member 132 is greater than the width of the distance between the vertical support structures 118 at the intersection between the vertical support structures and the rotation path of the collapsible support bar 130, allowing unobstructed rotation of the "C" shaped member 132.

Figure 8:
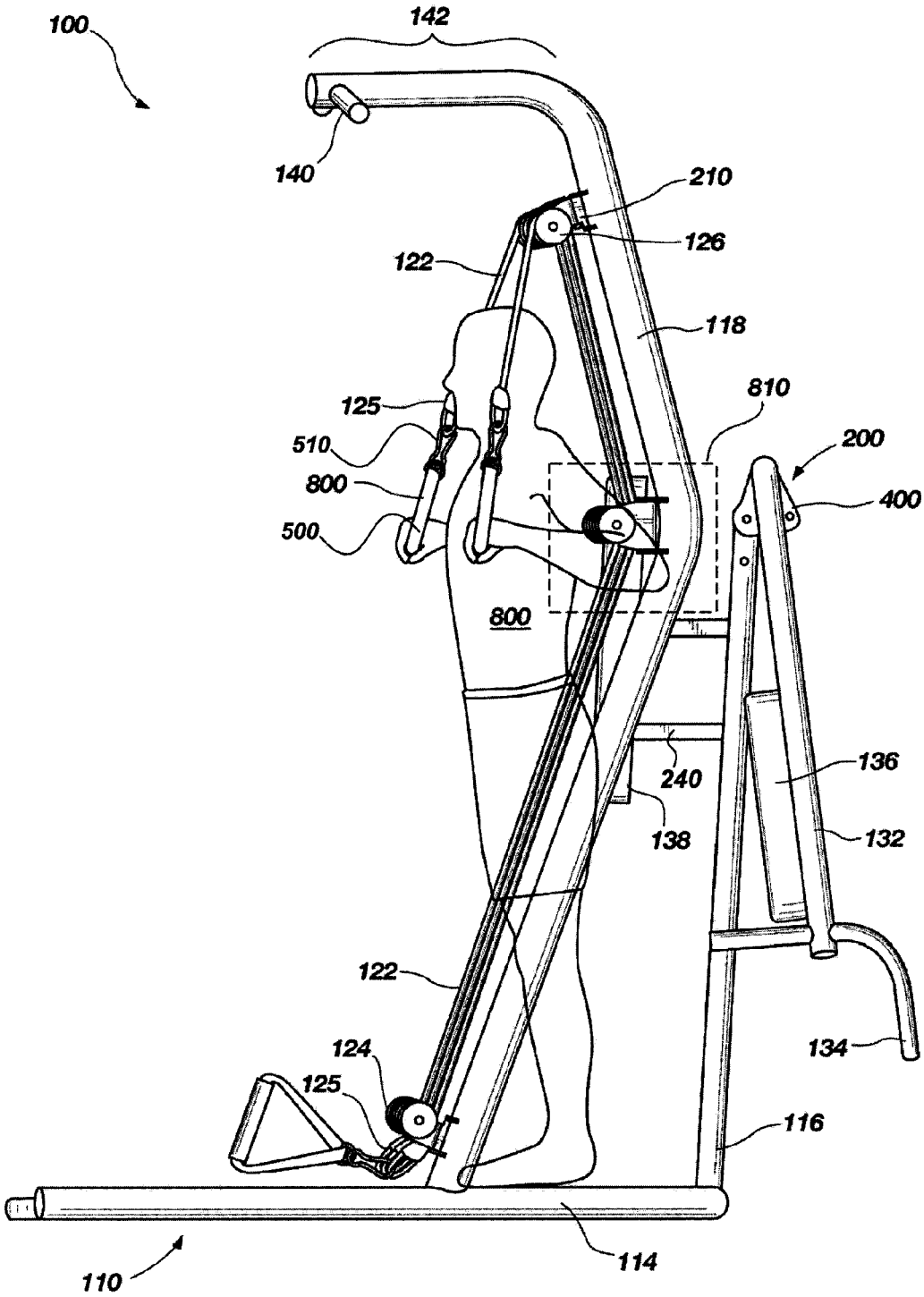
FIG. 8 is a side view of a resistance based exercise apparatus in a second configuration including a user, according to one exemplary embodiment.
Figure 9:
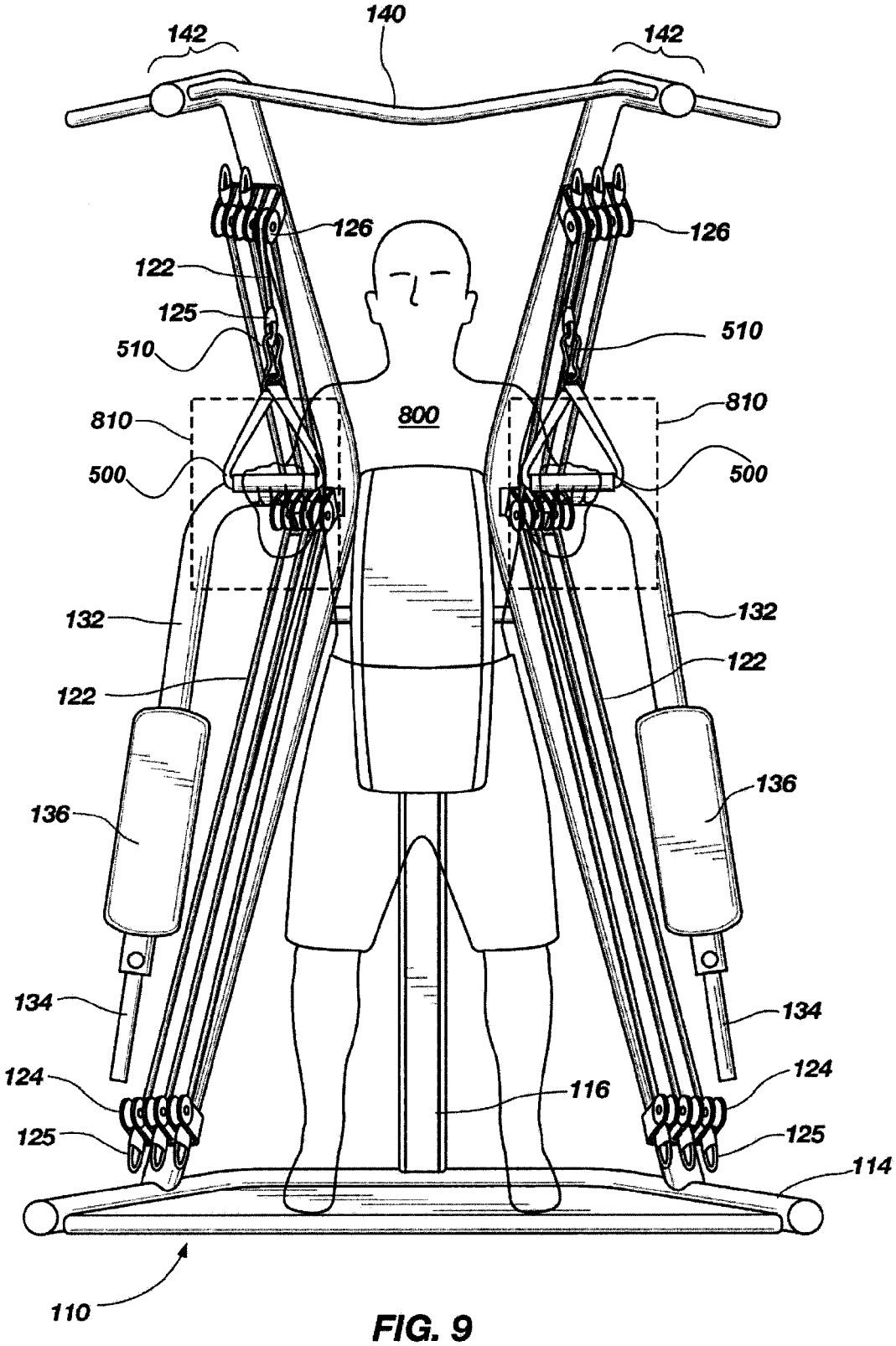
FIG. 9 is a frontal view of a resistance based exercise apparatus in a second configuration including a user, according to one exemplary embodiment.
Figure 10:
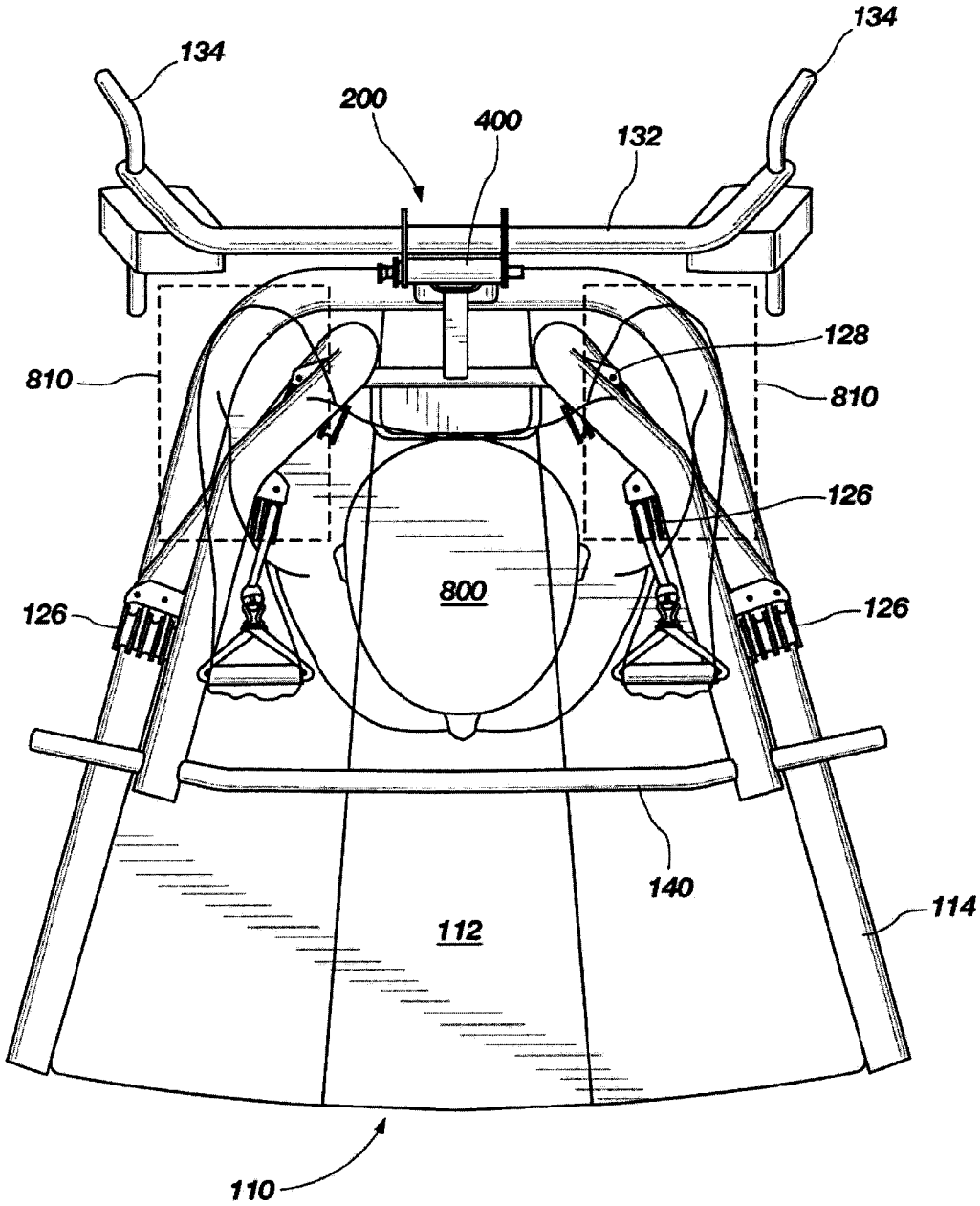
FIG. 10 is a top view of a resistance based exercise apparatus in a second configuration including a user, according to one exemplary embodiment.

FIGS. 8-10 illustrate the freedom of movement afforded a user 800 by the present exemplary system 100. As illustrated, when the collapsible support bar 130 is rotated into its second position perpendicular with the base 110, a user 800 is able to position herself against the back pad 138 and enjoy substantially unobstructed motion. For example, as illustrated in FIGS. 8-10, a user may wish to perform any number of resistance based exercises where one's hands are initially brought to one's chest. As illustrated, this configuration causes the elbow to be positioned behind and to the side of the user's back in the range of motion area 810 identified in the figures by the dashed line. As shown, the converging and diverging shape of the vertical support structures 118 allow for reclamation of this area when compared to traditional systems. Consequently the resulting system 100 provides for an increased range of motion for the user while maintaining system stability.

Alternative Embodiments

Figure 11:
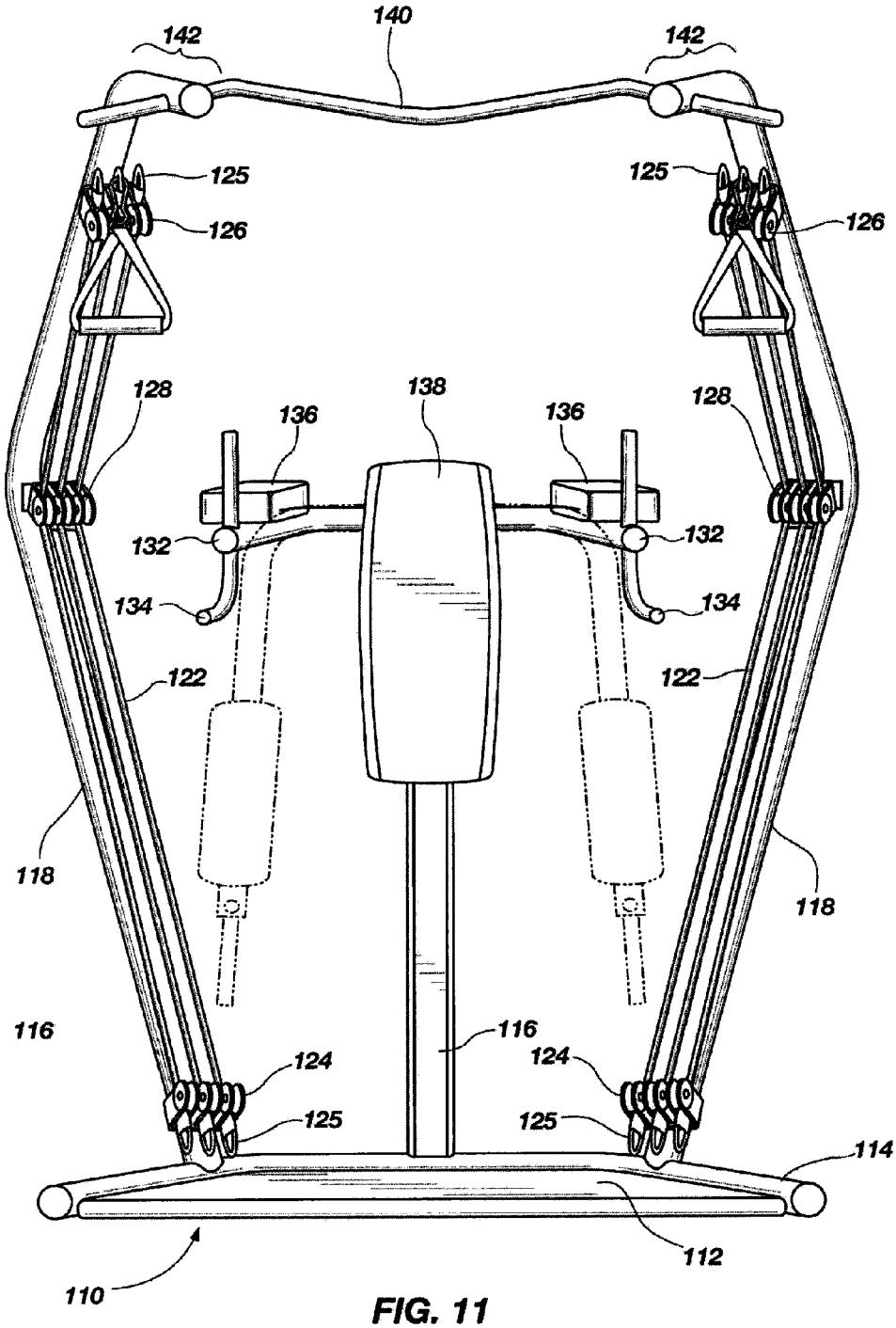
FIG. 11 is a frontal view of a resistance based exercise apparatus, according to an alternative exemplary embodiment.

According to one alternative embodiment illustrated in FIG. 11, the present exemplary system may have vertical support structures 118' with diverging and converging members. Specifically, as illustrated in FIG. 11, clearance around the user may be accomplished by forming a diamond shape or a generally ellipsoid shape with the vertical support structure 118'. As illustrated, the intermediate rollers can be placed at the vertex of the vertical support structures 118' in order to smoothly transition the elastic members 122 in a non-linear orientation between the top and bottom rollers. As noted previously, by translating the center location of the elastic members 112 between the top and bottom rollers away from the likely position of the user's arms, the exercise area available to the user is maximized.

INDUSTRIAL APPLICABILITY

In general, the structure of the present exemplary disclosure provides an apparatus having a relatively small footprint while enabling the performance of numerous full range motion exercises. More specifically, the present exemplary apparatus includes a frame made of a number of vertically oriented support members that converge relative to one another from the base they are coupled to until they each form a vertex, upon which the support members then diverge. This configuration minimizes the size of the system's stabilizing footprint by allowing space for the user's arms to operate around the vertically oriented structure. That is, the combined distance between the outer surfaces of the vertical support members is minimized where the vertices meet. This area is, according to one exemplary embodiment, designed to coincide with the area a typical user would desire space to perform various full range arm exercises. By positioning the vertices according to the present disclosure, a user's arms may actually employ a range of motion that includes areas behind the support members. Furthermore, the range of motion is accomplished while maintaining stability of the system. Particularly, the converging and subsequently diverging nature of the vertical support members minimizes the likely generation of a tipping force on the apparatus as reactionary forces caused by actuation of the system are transferred to stable portions of the base.

In some configurations, at least one resistance assembly including at least one elastic member is coupled to the vertical support members to allow for the performance of resistance based exercises. In this embodiment, the resistance members are coupled to the vertical support frame by a system of at least three guides, such as rollers. Placement of the guides at the upper and lower extremes of each vertical support frame as well as at or near the vertex of each vertical support frame results in the resistance members generally following the orientation of the vertical support frames and preserving the area surrounding the arms of a user free from system elements.

Furthermore, according to one configuration, the vertical support members of the frame are oriented such that they both initially angle from the base toward the back of the system. The backward directed angle of the vertical support members terminates at the vertices and the support members are then directed forward. This configuration also increases the space available for movement of the user's arms while maximizing stability. The initial angle of the vertical support members may originate near the median plane of the base to further add to the stability of the apparatus.

Optionally, a selectively collapsible support bar may also be rotatably coupled to the system via a vertically oriented base extension disposed on the rear portion of the base. The inclusion of the selectively collapsible support bar allows for the performance of a number of body-weight based exercises. Additionally, as disclosed above, the selectively collapsible support bar is sized such that with the actuation of a pivot assembly, the collapsible support bar is rotated to a vertical position behind the vertical support structures. When in this position, the arm motion of the user remains uninhibited.

In conclusion, the present system and method provides a compact exercise system that enables the performance of multiple exercises by maximizing the user's freedom of motion without compromising the stability of the resulting system. More specifically, the present exemplary system assumes a plurality of different stable configurations to facilitate the performance of various exercises while maximizing the freedom of motion for the user.

What is claimed is:

1. An exercise apparatus, comprising: a base; a first vertical support member coupled to said base; a second vertical support member coupled to said base; and a resistance assembly coupled to said first vertical support member and said second vertical support member; wherein said first and second vertical support members converge rearwardly and inwardly relative to one another to form a first vertex and a second vertex; and wherein said first support member and said second support member diverge forwardly and laterally relative to one another above said first vertex and said second vertex.

2. The exercise apparatus of claim 1, wherein said resistance assembly further comprises:

a first resistance assembly disposed on said first vertical support member; and a second resistance assembly disposed on said second vertical support member.

3. The exercise apparatus of claim 2, wherein:

said first resistance assembly follows a profile of said first support member; and said second resistance assembly follows a profile of said second support member.

4. The exercise apparatus of claim 2, wherein said first resistance assembly further comprises:

at least one elastic resistance member, said at least one elastic resistance member having a first end and a second end;

a first coupling feature connected to said first end of said at least one elastic resistance member;

a second coupling feature connected to said second end of said at least one elastic resistance member;

a top guide corresponding to said at least one elastic resistance member, said top guide being coupled to a top portion of said first vertical support member above said first vertex;

a bottom guide corresponding to said at least one elastic resistance member below said first vertex, said bottom guide being coupled to a bottom portion of said first vertical support member; and an intermediate guide corresponding to said at least one elastic resistance member, said intermediate guide being coupled to said first vertical support member at said vertex.

5. The exercise apparatus of claim 4, wherein:

said top guide and said bottom guide each define an opening configured to facilitate passage of said at least one elastic resistance member; and wherein said first coupling feature and said second coupling feature each have a maximum width that is greater than said opening defined by said top guide and said bottom guide.

6. The exercise apparatus of claim 4, wherein said second resistance assembly further comprises:

at least one elastic resistance member, said at least one elastic resistance member having a first end and a second end;

a first coupling feature connected to said first end of said at least one elastic resistance member;

a second coupling feature connected to said second end of said at least one elastic resistance member;

a top guide corresponding to said at least one elastic resistance member, said top guide being coupled to a top portion of said second vertical support member above said second vertex;

a bottom guide corresponding to said at least one elastic resistance member, said bottom guide being coupled to a bottom portion of said second vertical support member above said second vertex; and an intermediate guide corresponding to said at least one elastic resistance member, said intermediate guide being coupled to said second vertical support member at said second vertex.

7. The exercise apparatus of claim 4, wherein said elastic member is freely retained between said top guide, said intermediate guide, and said bottom guide such that said at least one elastic member is configured to be selectively actuated from said first end and said second end.

8. The exercise apparatus of claim 1, further comprising:

a vertically oriented base extension member having a first end and a second end, wherein said first end of said vertically oriented base extension member is coupled to a back portion of said base; and a back pad coupled to said second end of said vertically oriented base extension member;

wherein said back pad is disposed at said vertex of said first vertical support member and said vertex of said second vertical support member.

9. The exercise apparatus of claim 8, further comprising a support bar coupled to said second end of said vertically oriented base extension member, wherein said support bar is configured to project parallel to said base around said vertex of said first vertical support member and said vertex of said second vertical support member in a first position.

10. The exercise apparatus of claim 9, further comprising:

a pivot assembly coupling said support bar to said second end of said vertically oriented base extension member, wherein said pivot assembly is configured to selectively position said support bar in said first position and a second position;

wherein said second position includes said support bar oriented substantially perpendicular to said base.

11. The exercise apparatus of claim 10, wherein said support bar comprises a "C" shaped member having a back portion and a plurality of protruding members;

wherein a distance between said protruding members is sufficiently wide to rotate said support bar about said pivot assembly coupled to said vertically oriented base extension member without engaging said first and second support member.

12. The exercise apparatus of claim 1, further comprising a substantially horizontal protrusion disposed on top of each of said first and second support member.

13. The exercise apparatus of claim 12, further comprising a horizontally oriented pull-up bar traversing said substantially horizontal protrusion disposed on top of each of said first and second support members substantially above a median plane of said base.

14. The exercise apparatus of claim 1, wherein:

said base includes a front surface, a back surface, a first side surface, and a second side surface;

said first vertical support member is coupled to said base near a midpoint of said first side surface;

said second vertical support member is coupled to said base near a midpoint of said second side surface;

said first and second vertical support members below said first and second vertex are oriented toward said back surface of said base; and said first and second vertical support members above said first and second vertex are oriented toward said front surface of said base.

15. The exercise apparatus of claim 1, wherein said first vertex and said second vertex are coincident.

16. The exercise apparatus of claim 14, wherein said first vertical support member and said second vertical support member are coupled near said vertex.

17. An exercise apparatus, comprising: a base; a first vertical support member coupled to said base; a second vertical support member coupled to said base; wherein said first and second support members converge rearwardly and inwardly relative to one another and are coupled at a vertex and wherein said first and second support members diverge forwardly and laterally relative to said vertex; and at least one resistance assembly disposed on said first vertical support member including at least one elastic resistance member, said at least one elastic resistance member having a first end and a second end, a first coupling feature connected to said first end of said at least one elastic resistance member, a second coupling feature connected to said second end of said at least one elastic resistance member, a top guide corresponding to said at least one elastic resistance member, said top guide being coupled to a top portion of said first vertical support member above said vertex, a bottom guide corresponding to said at least one elastic resistance member, said bottom guide being coupled to a bottom portion of said first vertical support member below said vertex; and an intermediate guide corresponding to said at least one elastic resistance member, said intermediate guide being coupled to said first vertical support member at said vertex.

18. The exercise apparatus of claim 17, further comprising:

a vertically oriented base extension member having a first end and a second end, wherein said first end of said vertically oriented base extension member is coupled to a back portion of said base;

a back pad coupled to said second end of said vertically oriented base extension member, wherein said back pad is disposed at said vertex; and a support bar coupled to said second end of said vertically oriented base extension member by a pivot assembly configured to selectively position said support bar in a first position parallel to said base around said vertex and a second position includes said support bar oriented substantially perpendicular to said base.

wherein said support bar is a "C" shaped member having a back portion and a plurality of protruding members, wherein a distance between said protruding members is sufficiently wide to rotate said support bar about said pivot assembly coupled to said vertically oriented base extension member without engaging said first and second support member.

19. The exercise apparatus of claim 17, further comprising:

a substantially horizontal protrusion disposed on top of each of said first and second support member; and a horizontally oriented pull-up bar traversing said substantially horizontal protrusion disposed on top of each of said first and second support member substantially above a median plane of said base;

wherein said base includes a front surface, a back surface, a first side surface, and a second side surface, said first vertical support member being coupled to said base near a midpoint of said first side surface, said second vertical support member being coupled to said base near a midpoint of said second side surface, said first and second vertical support members below said vertex being oriented toward said back surface of said base, and said first and second vertical support members above said vertex being oriented toward said front surface of said base.

20. An exercise apparatus, comprising:

a base including a front surface, a back surface, a first side surface, and a second side surface;

a first vertical support member coupled to said base on said first side near a center of said first side;

a second vertical support member coupled to said base on said second side near a center of said second side, wherein said first and second support members converge relative to one another to form a first vertex and a second vertex and wherein said first and second support members diverge relative to one another above said first and second vertex; and a first resistance assembly disposed on said first vertical support member including at least one elastic resistance member, said at least one elastic resistance member having a first end and a second end, a first coupling feature connected to said first end of said at least one elastic resistance member, a second coupling feature connected to said second end of said at least one elastic resistance member, a top guide corresponding to said at least one elastic resistance member, said top guide being coupled to a top portion of said first vertical support member above said first vertex, a bottom guide corresponding to said at least one elastic resistance member, said bottom guide being coupled to a bottom portion of said first vertical support member below said first vertex; and an intermediate guide corresponding to said at least one elastic resistance member, said intermediate guide being coupled to said first vertical support member at said first vertex;

a second resistance assembly disposed on said second vertical support member including at least one elastic resistance member, said at least one elastic resistance member having a first end and a second end, a first coupling feature connected to said first end of said at least one elastic resistance member, a second coupling feature connected to said second end of said at least one elastic resistance member, a top guide corresponding to said at least one elastic resistance member, said top guide being coupled to a top portion of said second vertical support member above said second vertex, a bottom guide corresponding to said at least one elastic resistance member, said bottom guide being coupled to a bottom portion of said second vertical support member below said second vertex, and an intermediate guide corresponding to said at least one elastic resistance member, said intermediate guide being coupled to said second vertical support member at said second vertex;

a vertically oriented base extension member having a first end and a second end, wherein said first end of said vertically oriented base extension member is coupled to a back portion of said base;

a back pad coupled to said second end of said vertically oriented base extension member, wherein said back pad is disposed at said first vertex and said second vertex;

a support bar coupled to said second end of said vertically oriented base extension member by a pivot assembly configured to selectively position said support bar in a first position parallel to said base around said vertex of said first vertical support member and said vertex of said second vertical support member and a second position includes said support bar oriented substantially perpendicular to said base;

wherein said support bar is a "C" shaped member having a back portion and a plurality of protruding members, wherein a distance between said protruding members is sufficiently wide to rotate said support bar about said pivot assembly coupled to said vertically oriented base extension member without engaging said first and second support member a substantially horizontal protrusion disposed on top of each of said first and second support member; and a horizontally oriented pull-up bar traversing said substantially horizontal protrusion disposed on top of each of said first and second support member substantially above a median plane of said base;

wherein said first vertical support member is coupled to said base near a midpoint of said first side surface, second vertical support member is coupled to said base near a midpoint of said second side surface, said first and second vertical support members below said first and second vertex are oriented toward said back surface of said base, and said first and second vertical support members above said first and second vertex is oriented toward said front surface of said base.

* * * * *